United States Patent [19]

Eisel

[11] 4,183,731

[45] Jan. 15, 1980

[54] PROCESS AND APPARATUS FOR PRODUCING SHAPED LUMPS FROM COKE FINES OR CHARCOAL FINES

[75] Inventor: Ursula Eisel, Berlin, German Democratic Rep.

[73] Assignee: Bauakademie der Deutschen Demokratischen Republik, Berlin, German Democratic Rep.

[21] Appl. No.: 928,413

[22] Filed: Jul. 26, 1978

[30] Foreign Application Priority Data

Aug. 12, 1977 [DD] German Democratic Rep. ... 200547

[51] Int. Cl.[2] ..... C10L 5/00; C10L 5/22

[52] U.S. Cl. ..... 44/10 C; 44/10 R; 44/10 G; 44/2; 44/13; 100/90

[58] Field of Search ..... 44/10 C, 10 R, 2, 11–13, 44/10 G; 100/90

[56] References Cited

U.S. PATENT DOCUMENTS 2,164,950 7/1939 Schulze ..... 44/13 X 2,610,115 9/1952 Lykken ..... 44/2 X

FOREIGN PATENT DOCUMENTS 1193776 6/1970 United Kingdom ..... 44/13

*Primary Examiner*—Carl F. Dees

*Attorney, Agent, or Firm*—Michael J. Striker

[57] ABSTRACT

The coke fines or charcoal fines are mixed with a liquid binding agent at an elevated temperature in a mixing chamber sealed from an attached mold and are then abruptly rushed into the mold after opening the disclosure to the mixing chamber and causing a vacuum to form in the mold. This results in an implosion action. Thereafter the mold is again sealed against the mixing chamber and the excess binding agent is removed by suction from the mold. The mold is provided at its inner surface with ridges causing lines of thinned cross section to form in the mass of coke or coal fines. The mass is then poured into an adjoining collecting vessel and is simultaneously caused to break up into individual lump pieces along the said thin cross sectional lines.

8 Claims, 2 Drawing Figures

PROCESS AND APPARATUS FOR PRODUCING SHAPED LUMPS FROM COKE FINES OR CHARCOAL FINES

BACKGROUND OF THE INVENTION

The present invention relates to a process and apparatus for forming shaped lumps from coke fines and charcoal fines or dross.

The production of coke in general has the object to provide for a fuel with a highly reactive surface and a concentrated contents of carbon. For metallurgical processes such as those in a blast furnace, coke is required having a specific pressure resistance, abrasion resistance and reactivity. Besides, the coke should have a uniform minimum lump size.

These requirements can be met only if for the coke production coal types are selected by conventional methods. These types, however, amount only to about 10% of the normal coal supply. The coal industry has therefore developed processes by which the coke, particularly shaped coke such as briquettes, is made from highly volatile poorly baking or not baking coal types or mixture of these coal types to which coke fines or dross may be added.

These coal types are formed into briquettes after a thermal pretreatment or upon addition of binding agents and are subjected to a thermal hardening treatment or low temperature burning. (Federal Republic of Germany: Pat. No. 881,188; Published application No. 1,180,713; Pat. No. 834,691; Pat. No. 852,835; Pat. No. 1,031,798; Published application No. 1,696,509, and Published application No. 2,358,122).

Shaped coke bodies have also been made from fine grain size coking or non-coking coal or coke fines to which solid and/or liquid binding agents may be added by means of pelletizing trays or in pelletizing drums while subjecting the material to a rolling or rolling-off movement. These pellets are then subjected to coking and hardening or firing possibly after predrying. (Federal Republic of Germany: Published applications Nos. 1,571,703, 1,571,698 and 1,671,366).

The drawbacks of these processes are mainly that they must be carried out in several stages and apparatus and that a large amount of energy is necessary for the thermal heating or coking steps.

The briquetting process also limits the gas permeability of the shaped coke by a comparatively dense outer layer. Coke pellets on the other hand are not up to highest standards in regard to their mechanical resistance and their uniformity of lump size.

The processes are also generally limited to particular types of coal as already mentioned and permit only use of small amounts of coke dross or permit use only of coke dross of a very fine and uniform grain size.

In the production of steels of high purity, charcoal has also been used as the reducing agent in the blast furnace. In this case about 10% of the amount of charcoal result in charcoal dross or fines which, with the processes of the prior art, cannot be turned to use at reasonable expense.

The process of the invention therefore has the object to permit forming lumps of uniform size with a desired porosity and strength in a single continuous process from a slurry made of a mixture of coke fines or coal fines and a conventional binding agent.

SUMMARY OF THE INVENTION

A mixture of coke fines or dross or coal fines and a liquid binding agent is fed at a specific temperature range into a storage bin or silo and there maintained at the desired mixing temperature. At the same time a vacuum of about 70 to 95% is caused to form in a hermetically closed mold chamber. A closure member between the silo and the mold chamber is then abruptly opened and the mold is filled by an implosion action and the mixture is thus subjected to a preliminary densifying action. After closing the passage between the two spaces the binding agent is removed from the mixture by means of a vacuum and the mass is accordingly further compressed corresponding to the loss of binding agent. After opening the mold the shaped coke fines or shaped coal fines are broken into fragments during the removal from the mold due to a ridged profile of the interior surface of the mold.

The apparatus for carrying out this process comprises a rectangular mold chamber which is open at the bottom and is supported along its edge by a base member. A detachable bolting device connects the mold chamber and the base member. The interior walls of the mold chamber form a relief of cross ribs which serve as fractionizing edges and edge forming members. At the lower edge of the mold there is provided a circumferential elastic compressible gasket which is seated on a gasket edge associated with the base member. Thus, a hermetically closed mold chamber is formed. In the base member there is provided a filter screen which closes the bottom of the mold and is pivoted so that it can swing outwards.

On top of the mold chamber there is provided a storage bin or silo which is formed as a mixer which can be heated. The mold may also be provided with additional heating means.

The inlet ducts of an exterior vacuum device lead into the base chamber.

The device operates as follows:

In the cavity of the mold a vacuum is caused to form by the vacuum device. This causes the mold which is bolted to the base member to be forced by atmospheric pressure against the elastic gasket and thus also against the gasket edge of the base member. The mold thus is hermetically closed against the atmosphere. As soon as the necessary vacuum in the mold is obtained, the opening of the lock gate leading to the storage bin is opened. Thus, the vacuum collapses in a sudden burst, an effect known as implosion. The slurry of coal fines thus is thrust in a sudden burst into the cavity of the mold. The cavity is thus completely filled and a densification of the mass occurs.

After closing the lock gate between the mold and the storage bin a further evacuation accomplishes the removal by suction of the excess mixing liquid and causes a further densification of the compressed body of coal fines in the mold. This again causes the ridges at the interior walls of the molds to be impressed on the compressed body of coal fines and thus to form a fragmentation profile. Then, after lifting the mold, the filter screen at its bottom is caused to swing outwards and the compressed body of coal fines is cast into a collector basin. During this action the compressed body breaks up into the desired individual fragments or lumps.

The thus formed shapes are suited for use as reducing agent and correspond in their quality to the reducing agents used in blast furnaces in the form of pellets or briquettes. The shaped bodies, however, are less costly to make since less costly apparatus and less labor is necessary for their production. As against the prior art processes there are also provided improved working conditions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
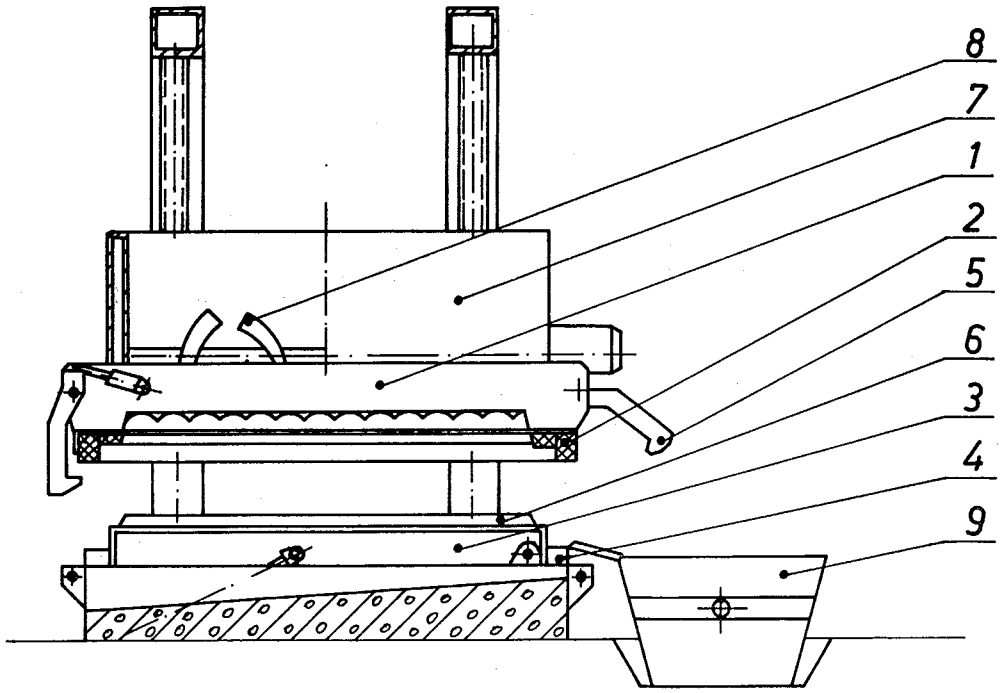
FIG. 1 is a longitudinal section through the apparatus used in the process of the invention.
Figure 2:
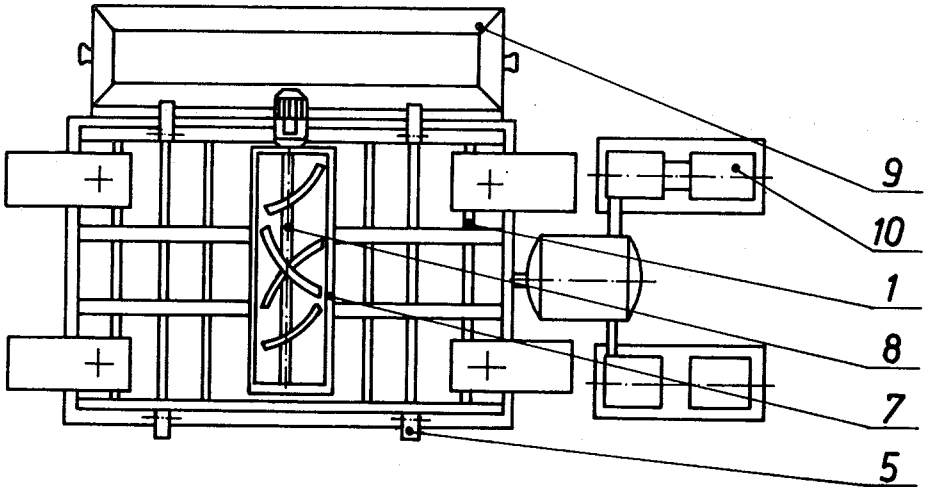
FIG. 2 is a plan view through the same apparatus.

With reference to the drawings it will be noted that there is provided a mold 1 which should consist of high quality steel and has a rectangular shape. A size of 3,000×6,000×80 mm has been found to be particularly useful. The edge of the mold which is open at the bottom is provided with a peripheral gasket 2 of rubber.

A base member 3 is formed of the same steel material and is open at its top. It is provided with a gasket seat 4 which supports the gasket 2 of the mold so as to close the cavity of the mold towards the outside. In order to provide for a firm connection between the mold and the base member the two parts are provided at their longitudinal sides with two oppositely arranged portions of a bolting device 5.

Within the base member a filter screen 6 is provided and secured to one of its longitudinal edges. It may consist of a frame which holds a steel wire network. The filter screen is arranged for swinging outwards about this longitudinal edge into a vertical plane.

On top of the mold 1 a silo or storage bin 7 is provided which is formed as a mixing chamber 8 which can be heated to the desired mixing temperature.

The interior surface of the mold is provided with crosswise arranged ribs. These ribs protrude by about 30 mm and have a thickness of about 8 mm. They act as the fragmentation forming members.

Two inlet ducts of flexible hose conduits lead into the bottom of the base member 3. The hose ducts connect with the vacuum device 10. They are provided with valves which can be actuated from the outside and may open or close the inlet.

A collecting basin 9 of ordinary steel sheet is provided at equal level adjoining the base member 3. The filter screen 6 thus can swing outwards into a position on top of the collector basin.

The vacuum device 10 is provided with measuring devices which indicate both the performance of the vacuum pumps and the level of vacuum caused to form in the mold 1. The storage bin 7 is also provided with measuring devices which indicate the mixing temperature of the mass within the bin.

The operation of the apparatus and the process for making uniform sizes from coal fines and a liquid binding agent is as follows:

The mold 1 is placed on the gasket edge 4 of the base member 3 and is bolted by means of the device 5 to the base member.

The storage bin or silo 7 is filled with a charge of coal fines and a cement suspension which are subjected to thorough mixing in the storage bin at a mixing temperature of +70° C. During this mixing steps a lock gate between the storage bin 7 and the mold 1 is closed. Thus, while the mixing takes place in the storage bin a vacuum of at least 70% can be caused to form in the mold by means of the vacuum device 10.

As soon as the mixing step has been completed and the required vacuum has been obtained the lock gate between the storage bin and mold is opened. At that moment the heated slurry of coal fines abruptly drops out of the bin 7 into the mold at such speed that it fills the mold completely in a sudden burst and at the same time undergoes a high degree of densification.

The locking gate between the storage bin and mold is then again closed and the vacuum device 10 is again turned on which causes the excess water which is present in the mold and which was used to form the cement suspension to be removed by suction through the filter screen 6 towards the outside.

After the excess water has been completely removed by suction the vacuum device 10 is turned off, the bolt device 10 is opened and the mold 1 is lifted from the base member 3 to a degree that the formed body of coal fines which rests now on the filter screen 6 and has impressed on it the necessary fragmentation profile can be tilted by swinging out the filter screen. This will cause the formed mass of coal fines to drop into the collection basin 9 and this action in turn causes the formed mass to be fragmented into the desired lumps.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A process for producing shaped fragments or lumps from coke fines or coal fines comprising mixing the coke or coal fines with a liquid binding agent in a mixing chamber at an elevated temperature to form a suspension mass;

applying a partial vacuum in a mold which at that point is closed against the mixing chamber;

then abruptly opening the passage from the mixing chamber to the mold and causing the mass of coke or coal fines and binding agent to be propelled into said mold by an implosion action and thus to be compressed;

then after again closing the passage from the mold to the mixing chamber removing the excess liquid in the binding agent from the mold by suction resulting in further compression of the mass of coke or coal fines;

at the same time imparting lines of thinned cross section to the mass through protruding means in the interior surface of the mold; and finally causing the mass to drop into storage means while simultaneously breaking up the mass into individual lumps or fragments along the said thin cross section lines.

2. The process of claim 1 wherein the mixing temperature for the said coke or coal fines and the liquid binding agent is equal to or greater than 40° C.

3. The process of claim 1 wherein the removal of the excess is effected by suction through an apertured bottom portion of the mold.

4. The process of claim 1 wherein the dropping of the mass into the storage means is effected by moving the said apertured bottom portion toward the vertical and thus causing the mass to drop into the adjoining storage means while breaking apart into the desired lumps or fragments.

5. An apparatus for producing shaped lumps or fragments from coke fines or coal fines, the said apparatus comprising a mixing chamber for mixing the coke or coal fines with a liquid binding agent to form a coke or coal suspension mass;

means for applying heat to said mixing chamber;

a mold;

a passage connecting said mold with said mixing chamber;

a closure adapted to open and close said passage from the mixing chamber to the mold;

means for applying a vacuum to said mold;

a discharge opening for said mold;

means for opening and closing said discharge opening;

collection means for receiving the formed mass when dropped from said mold; and protruding ridges provided in the interior surface of said mold for forming notches in said mass upon compression of the mass by being abruptly forced into the evacuated mold upon opening said closure means after applying said vacuum, the said notches causing the mass to split into individual lumps or fragments upon dropping into said collection means.

6. The apparatus of claim 5 which includes a base member for supporting said mold;

means for locking said mold to said base member;

cooperating gasket means for making the mold and base airtight, the said vacuum being applied through said base and an apertured bottom portion of said mold.

7. The apparatus of claim 6 wherein the said apertured bottom portion of the mold is covered by a filter member which is pivoted to permit its moving into a vertical plane so as to pour the said compressed mass into said collection means.

8. In a process for producing shaped bodies from coke fines or coal fines, the steps of mixing the coal or coal fines with a liquid binding agent to form a suspension; producing a partial vacuum in a mold; and causing the suspension to implode into the mold to thereby undergo compacting therein.

* * * * *